US008146307B1

(12) United States Patent
Loper et al.

(10) Patent No.: US 8,146,307 B1
(45) Date of Patent: Apr. 3, 2012

(54) TRIM ASSEMBLY

(75) Inventors: Thomas Loper, Wilbraham, MA (US); David Bilodeau, Hadley, MA (US)

(73) Assignee: Jain (Americas) Inc., Columbus, OH (US)

( * ) Notice: Subject to any disclaimer, the term of this patent is extended or adjusted under 35 U.S.C. 154(b) by 139 days.

(21) Appl. No.: 12/778,211

(22) Filed: May 12, 2010

Related U.S. Application Data

(60) Provisional application No. 61/177,345, filed on May 12, 2009.

(51) Int. Cl.
*E04B 2/00* (2006.01)

(52) U.S. Cl. ..... 52/287.1; 52/211; 52/519

(58) Field of Classification Search ..... 52/94, 211, 52/287.1, 288.1, 518, 519, 536, 478
See application file for complete search history.

(56) References Cited

U.S. PATENT DOCUMENTS

| | | | | |
|---|---|---|---|---|
| 2,757,421 | A | 8/1956 | Toney | |
| 3,046,616 | A | 7/1962 | Sampsell | |
| 3,307,309 | A | 3/1967 | Bloxsam | |
| 3,566,570 | A | 3/1971 | Evans | |
| 4,196,553 | A * | 4/1980 | Veach | 52/276 |
| 4,319,439 | A * | 3/1982 | Gussow | 52/288.1 |
| 4,753,056 | A | 6/1988 | Pacca | |
| 5,018,325 | A | 5/1991 | Geen et al. | |
| 5,159,794 | A | 11/1992 | Habbersett et al. | |
| 5,987,826 | A | 11/1999 | Petta | |
| 5,987,844 | A | 11/1999 | Reid et al. | |
| 6,125,605 | A | 10/2000 | Young | |
| 6,311,442 | B1 * | 11/2001 | Watanabe | 52/282.3 |
| 6,530,190 | B2 | 3/2003 | Conachen | |
| 2006/0207197 | A1 * | 9/2006 | Anderson | 52/211 |
| 2008/0148672 | A1 * | 6/2008 | Monteer | 52/533 |
| 2008/0172956 | A1 | 7/2008 | Boldt et al. | |

FOREIGN PATENT DOCUMENTS

| | | |
|---|---|---|
| GB | 2217763 | 11/1989 |

* cited by examiner

*Primary Examiner* — Brian Glessner
*Assistant Examiner* — Adam Barlow
(74) *Attorney, Agent, or Firm* — Roger A. Gilcrest

(57) ABSTRACT

A trim assembly for use in concealing open spaces created by siding materials, wherein the assembly comprises a trim member configured to cover and conceal the terminal edges of the siding while simultaneously creating an expansion channel which allows the siding to expand or contract without causing premature bulging, bowing, splintering, cracking, and the like. The assembly may further comprise an insert wherein the insert is configured to readily engage with the trim member, and where the insert in combination with the trim member creates the look of butted cedar siding. The insert is configured to allow the siding to expand and contract in both a horizontal and a vertical direction.

15 Claims, 10 Drawing Sheets

TRIM ASSEMBLY

CROSS REFERENCE TO RELATED APPLICATIONS

This application claims the benefit of U.S. Provisional Application No. 61/177,345 filed on May 12, 2009.

BACKGROUND OF THE INVENTION

1. Field of the Invention

The present invention relates generally to trim surrounding structural features, such as, doors, walls, windows, and the like. More particularly, the invention relates to a trim assembly formed around structural features, such as doors, walls, windows, and the like, wherein the trim assembly covers the siding and allows the siding to expand and contract according to its natural characteristics, while simultaneously enhancing the overall aesthetics of the siding.

2. Background of the Invention

A popular form of plastic siding is made to resemble clapboarding, and consists of a number of elongated pieces which are applied in overlapping relationship, similar to wooden clapboards, so as to shed water. Such synthetic siding has a tendency to buckle, bow, splinter, and crack when it is fixed too tightly to a wall or when it is otherwise restrained. Accordingly, when applying trim around such synthetic siding, consideration must be paid to the siding's inherent expansion/contraction characteristics. Furthermore, trim is typically applied by using caulking and/or adhesive materials. As such materials are messy and difficult to work with, what is needed is a trim that can be installed without the need for such materials.

Accordingly, what is needed in the art is a trim assembly which can allow the siding to expand and contract according to its inherent characteristics, and which can simultaneously enhance the overall aesthetics of the siding. Also needed is a trim assembly that can be installed relatively simply without the need for caulking and adhesives.

BRIEF SUMMARY OF THE INVENTION

The above-discussed drawbacks and deficiencies of the prior art are eliminated by a trim assembly for use in concealing open spaces created by siding, wherein the trim assembly comprises a trim member configured to conceal the terminal edges of the siding while simultaneously creating an expansion channel which allows the siding to expand and contract according to the siding's natural characteristics. The trim assembly may further comprise an insert wherein the insert is configured to readily engage with the trim member, and further wherein the insert in combination with the trim member creates the look of butted cedar siding. The insert is further configured to allow for the two-directional expansion and contraction of the siding, i.e., expansion and contraction in both the horizontal and vertical directions.

DETAILED DESCRIPTION OF THE INVENTION

The trim assembly of the present invention comprises a trim member which is configured to serve as a cornice, baseboard, molding, or other like border, such that the trim member may frame the edges of one or more courses of siding. Although the configuration and materials constituting the siding, which is framed by the inventive trim assembly disclosed herein, may vary to a wide degree, an exemplary siding is configured to resemble traditional "cedar shingle siding", or a "seaside style" of clapboards, wherein the lay of such siding is characterized by a series of vertically overlapping courses of siding. Additionally, the siding may be made out of a variety of materials, wherein exemplary materials include, for example, cellular polyvinylchloride ("cellular PVC"), wood, fiber cement, vinyl, metal, and the like, wherein cellular PVC is especially preferred. An exemplary siding configuration, with which the inventive trim assembly is particularly compatible, is depicted in FIG. 1.

Figure 1:
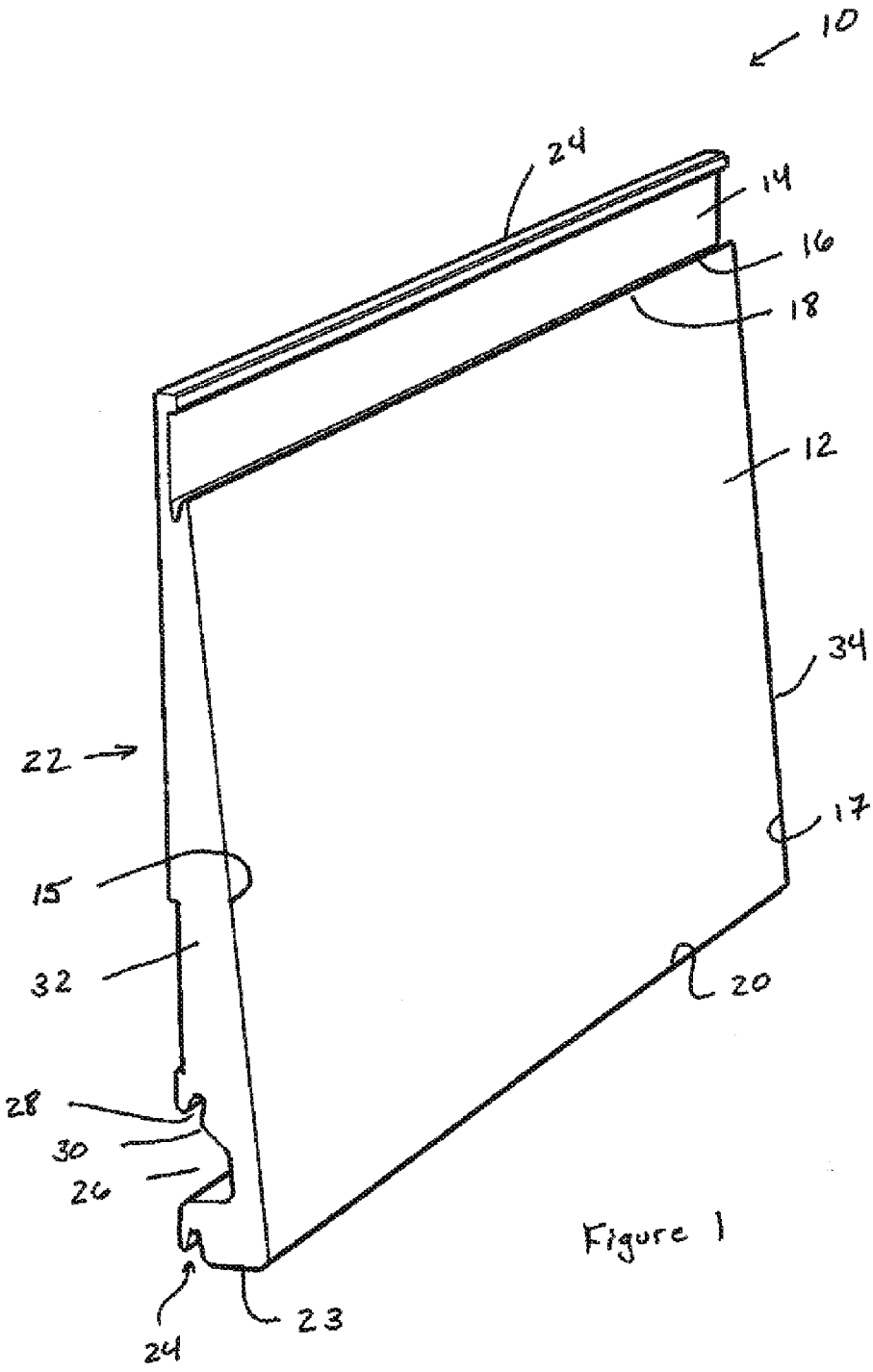
FIG. 1 is a schematic depicting an exemplary piece of siding.

Referring to FIG. 1, a siding 10 comprises a face 12 distinguished from a top portion 14 by a longitudinally extending head rabbet 16. Face 12 has a terminal lateral edge 15 opposite to a terminal lateral edge 17, and has as its uppermost boundary an upper edge 18, and has as its lowermost boundary a bottom edge 20, wherein bottom edge 20 turns rearward towards a back side 22 of siding 10 to form a bottom side 23. Bottom side 23 turns upwardly to form a longitudinally extending foot rabbet 24 on back side 22. Just upward of foot rabbet 24 moving towards top edge 24, back side 22 has longitudinally extending grooves 26 and 28 formed therein, wherein grooves 26 and 28 are separated by a longitudinally extending tongue 30. Foot rabbet 24 extends rearward past tongue 30. Lateral sides of siding 10 include lateral side 32 and lateral side 34. Lateral sides 32 and 34 gradually widen from top edge 24 to bottom edge 20 such that face 12 has an upward slope moving from upper edge 18 to bottom edge 20. In application, foot rabbet 24 is engaged with a head rabbet of another clapboard to give an overlapping visual effect to the paired clapboards.

The inventive trim member is configured to conceal siding which has at least one of lateral sides 32 and 34 exposed when the siding is properly installed. Not only is the trim member configured to improve the overall appearance of the siding when installed, for example, on a wall of a building, but it is also configured to allow the siding to expand and contract according to the siding's natural tendencies when exposed to fluctuating temperatures and humidity levels, thereby reducing the likelihood that the siding will prematurely bulge, splinter, crack, weather, and the like.

Figure 2:
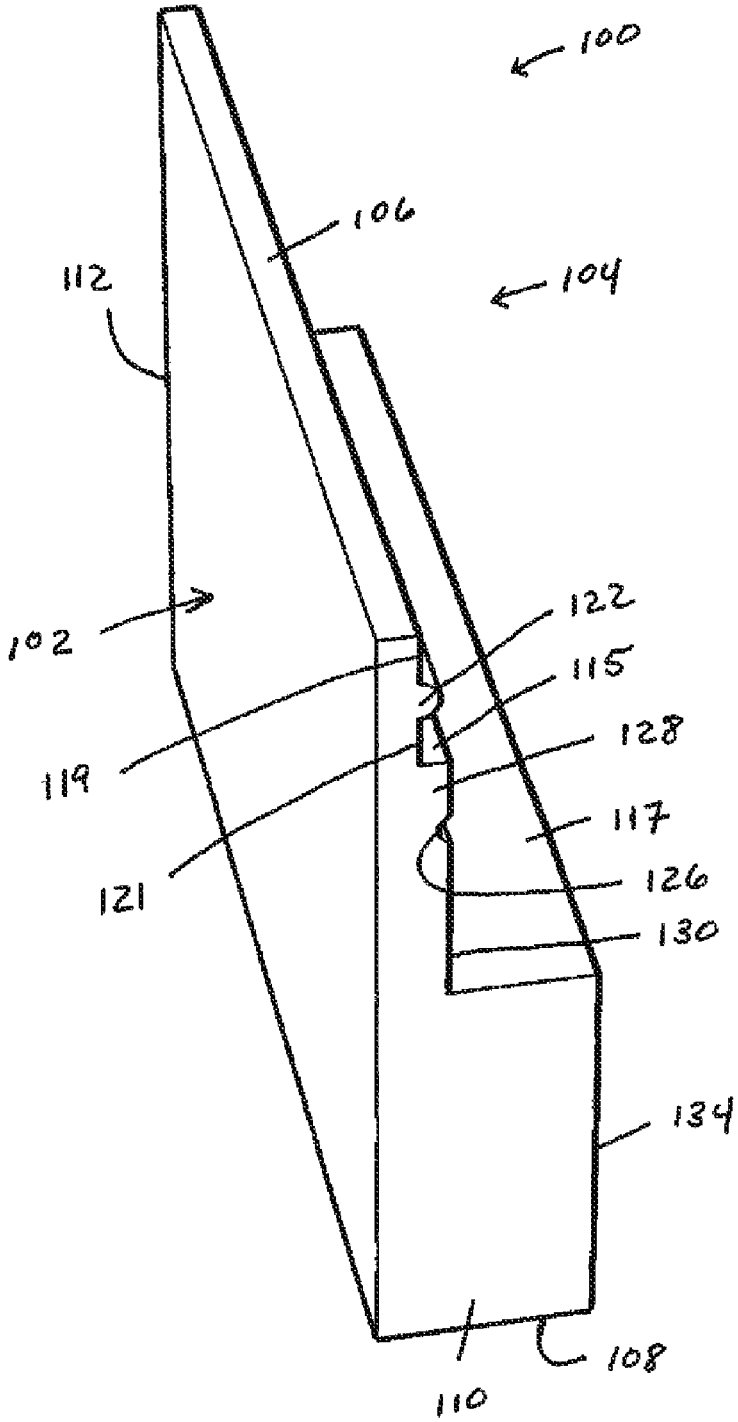
FIG. 2 is a schematic depicting an elevational view of a front side of an exemplary trim member.
Figure 3:
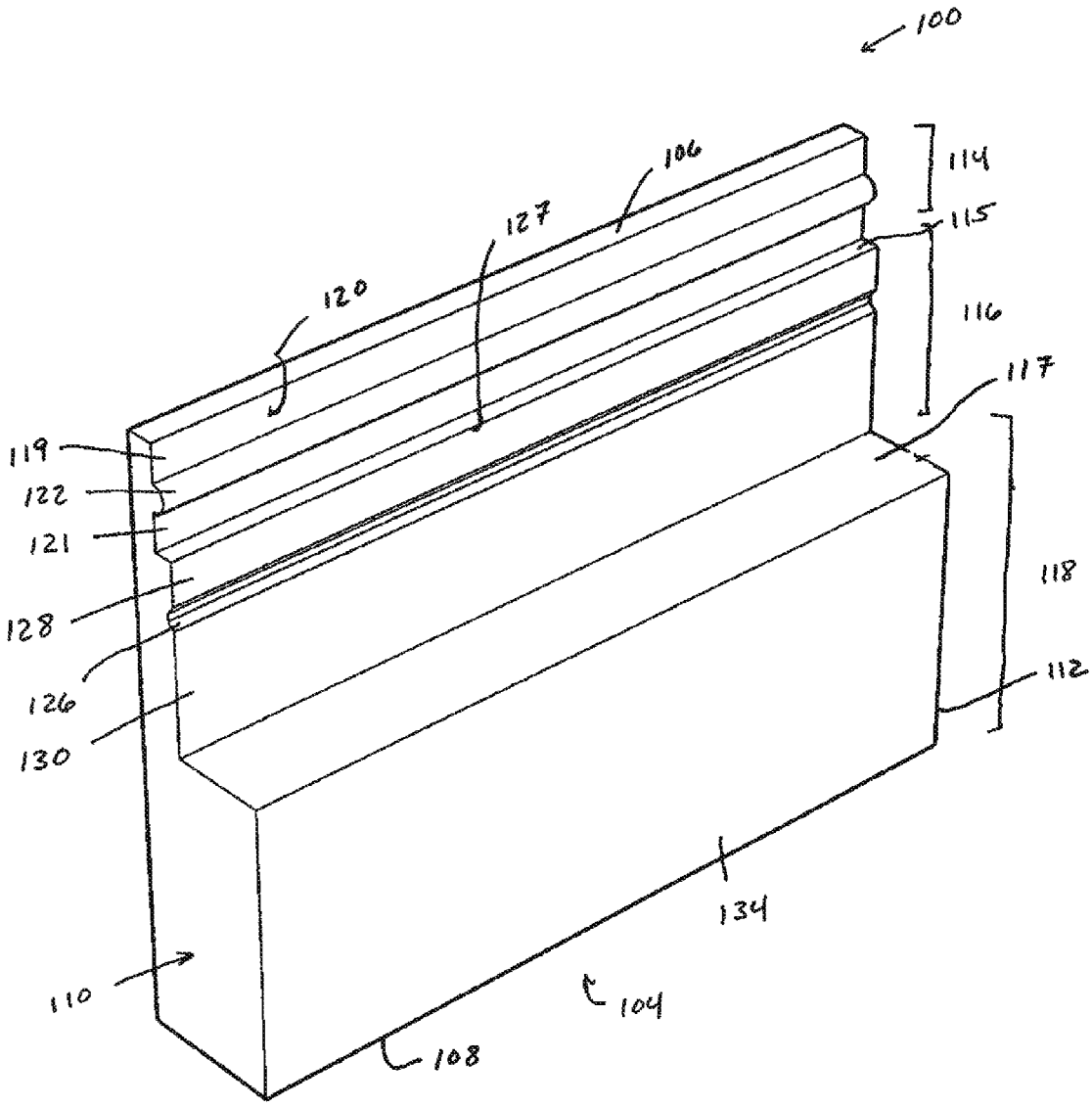
FIG. 3 is a schematic depicting an elevational view of a back side of the trim member depicted in FIG. 2.

An exemplary trim member 100 shall be described with reference to FIGS. 2 and 3. Trim member 100 comprises a longitudinally extending, and substantially planar front side 102 opposite to a longitudinally extending back side 104, and a longitudinally extending lateral side 106 opposite to a longitudinally extending lateral side 108, and a vertically extending lateral side 110 opposite to a vertically extending lateral side 112.

Back side 104 comprises three regions: an adaptor region 114, a guide region 116, and a base region 118. Guide region 116 is coterminous with and primarily extends rearward past adaptor region 114 via a step 115 of guide region 116, and base region 118 is coterminous with and extends rearward past guide region 116 via a step 117 of base region 118. Adaptor region 114 is coterminous with lateral sides 106, 110 and 112, guide region 116 is coterminous with lateral sides 110 and 112, and base region 118 is coterminous with lateral sides 108, 110, and 112.

Adaptor region 114 comprises a substantially planar surface 120 having a protrusion 122 extending outwardly, i.e., rearward, from a midsection thereof, wherein protrusion 122 extends along a length of substantially planar surface 120, i.e., extends along surface 120 from lateral side 110 to lateral side 112. Protrusion 122 divides planar surface 120 into a subsection 119 and a subsection 121. As will be understood in greater detail below, adaptor region 114 may be fitted with an inventive insert to create the appearance of butted cedar clapboard.

Guide region 116 comprises a substantially planar surface 124 having a groove 126 formed therein, wherein groove 126 divides surface 124 into a subsection 128 and a subsection 130. Groove 126 is formed approximately one third of the way down from a top edge 127 of subsection 128 such that subsection 128 is approximately one third a height of subsection 130. Groove 126 extends along a length of substantially planar surface 124, i.e., extends along surface 124 from lateral side 110 to lateral side 112.

As will be explained in greater detail below, groove 126 provides a position reference for the positioning of at least one of lateral sides 32 and 34 of siding 10 along trim member 100. When siding 10 is properly positioned relative to trim member 100, the distance between subsection 130 and groove 126 creates an expansion channel 129 (see, e.g., FIG. 7) which allows siding 10 to undergo its normal expansion and contraction thereby reducing the likelihood that siding 10 will buckle, bulge, bow, splinter, crack, and the like.

Again referring to FIGS. 2 and 3, base region 118 comprises a step 117 which is coterminous with and extends perpendicularly rearward from subsection 130 of guide region 116. Base region 118 further comprises a substantially planar surface 134, which is coterminous with lateral sides 108, 110, and 112, which turns perpendicularly downwards from step 117, and which terminates at longitudinally extending lateral side 108. As will be understood in greater detail below, substantially planar surface 134 may abut a portion of a wall to which there is no clapboard attached, i.e., an exposed portion of such wall, and longitudinally extending lateral side 108 may lie flush with an edge of such exposed portion of such wall.

Figure 7:
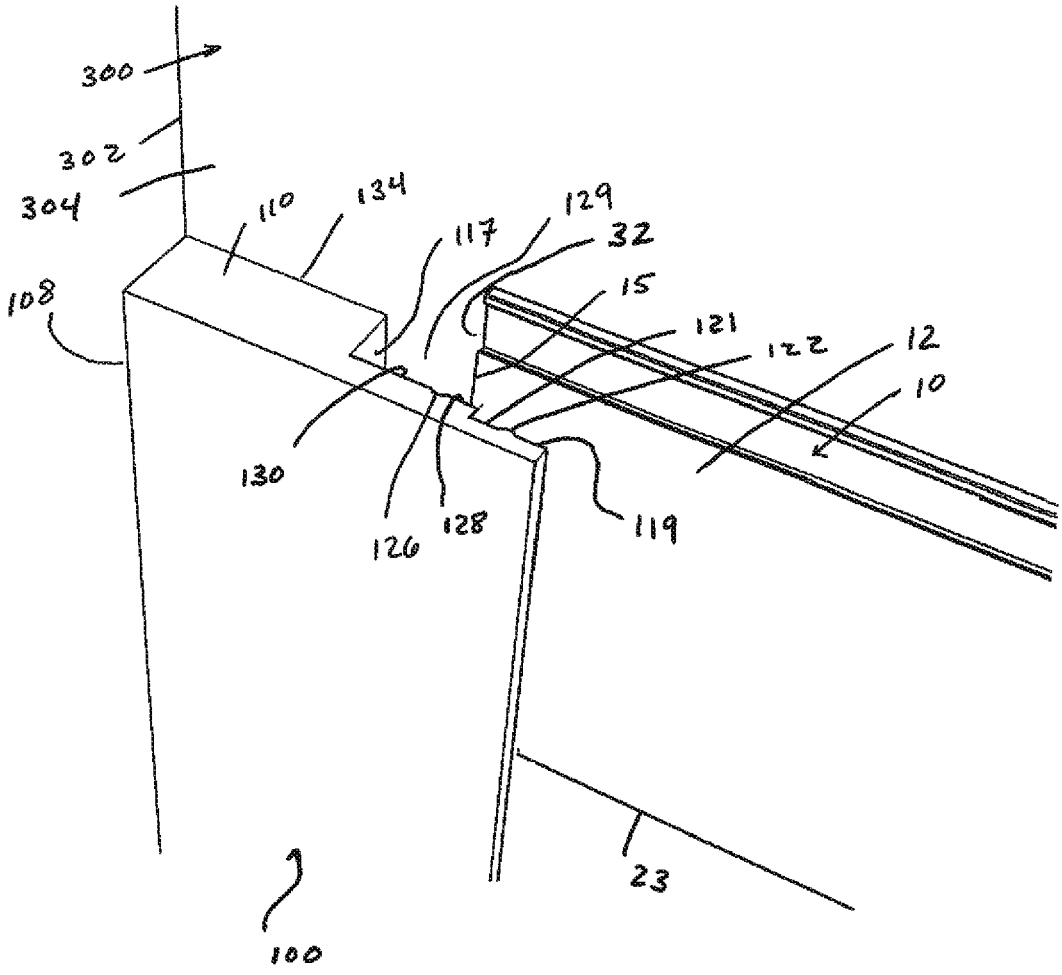
FIGS. 7 and 8 are schematics depicting an exemplary trim assembly and siding interaction.
Figure 8:
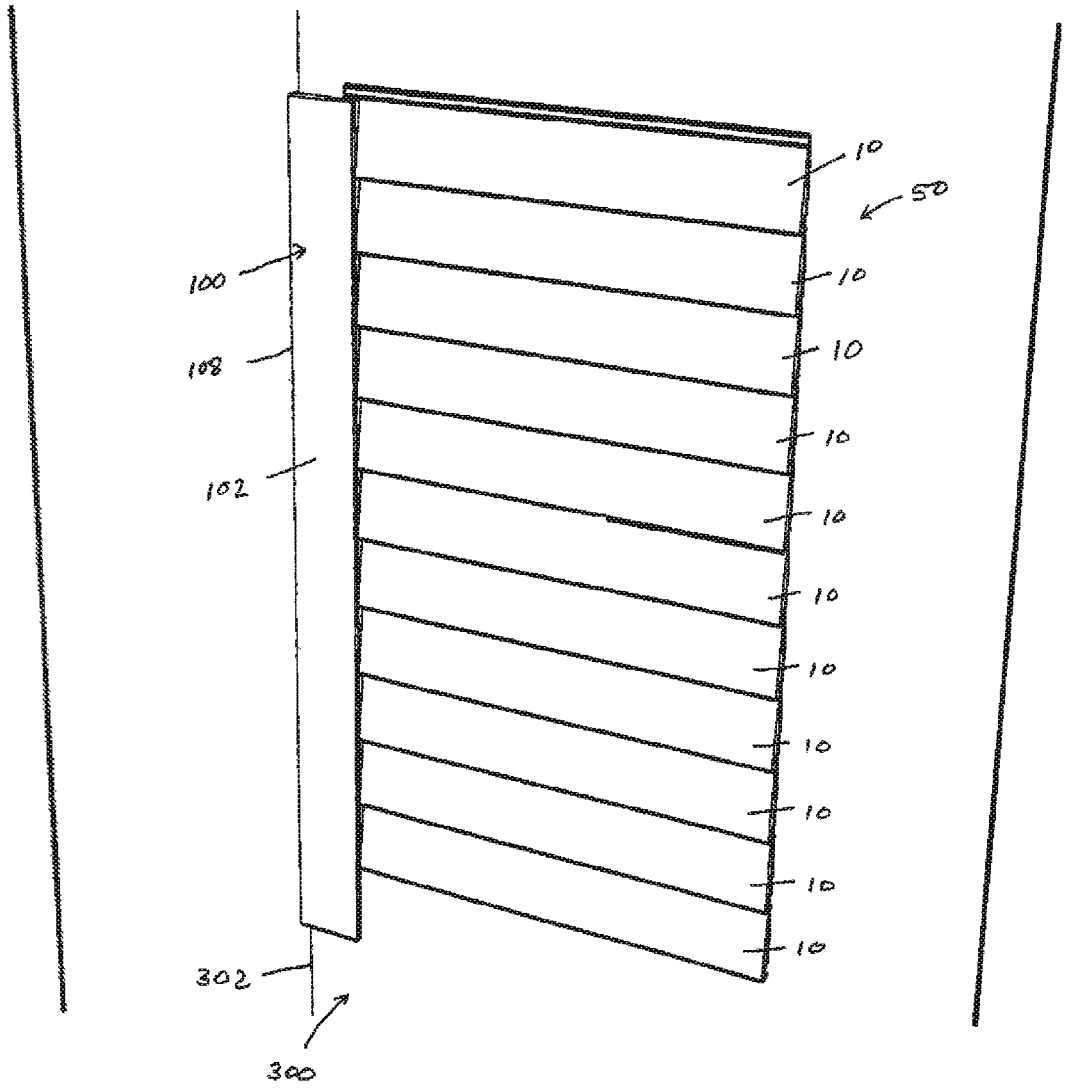

Referring to FIGS. 7 and 8, trim member 100 may be positioned over vertically overlapping siding 50 installed on a wall by aligning, e.g., terminal lateral edge 15 of siding 10 with groove 126 of trim member 100 such that expansion channel 129 is formed between lateral side 32 and step 117. A portion of face 12, which is coterminous with terminal lateral edge 15, rests against subsection 128 of guide region 116 of trim member 100 thereby leaving a gap between face 12 and subsections 119 and 121 of adaptor region 114. Additionally, where the siding is installed on a wall of a building, trim member 100 may be installed such that lateral side 108 is positioned flush with an edge 302 of a wall 300, and substantially planar surface 134 of base region 118 abuts a surface 304 of wall 300.

It is noted herein that it is further contemplated that trim member may be configured as a corner board as well, wherein, in this configuration, the trim member could comprise two trim members joined perpendicularly to each other at the bottom of the base regions of the two trim members, wherein the trim members could comprise all, or substantially all, of the same elements as described above with reference to trim member 100.

Figure 4:
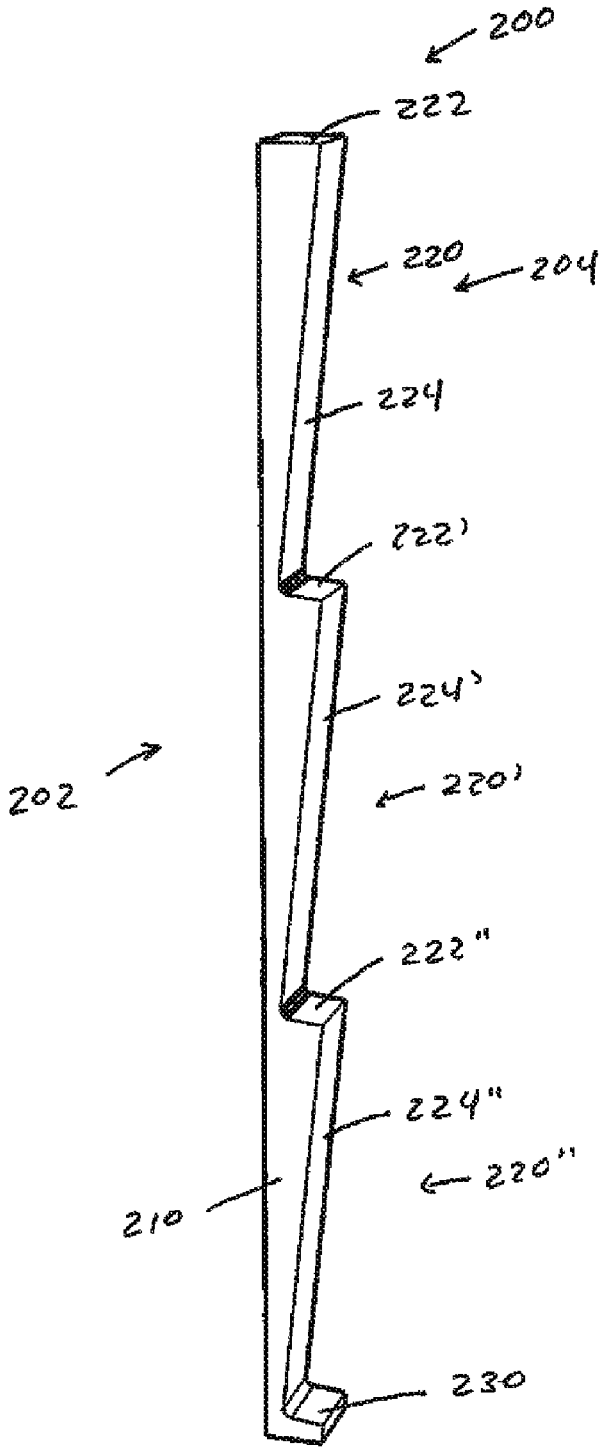
FIG. 4 is a schematic depicting a side view of an exemplary insert.
Figure 5:
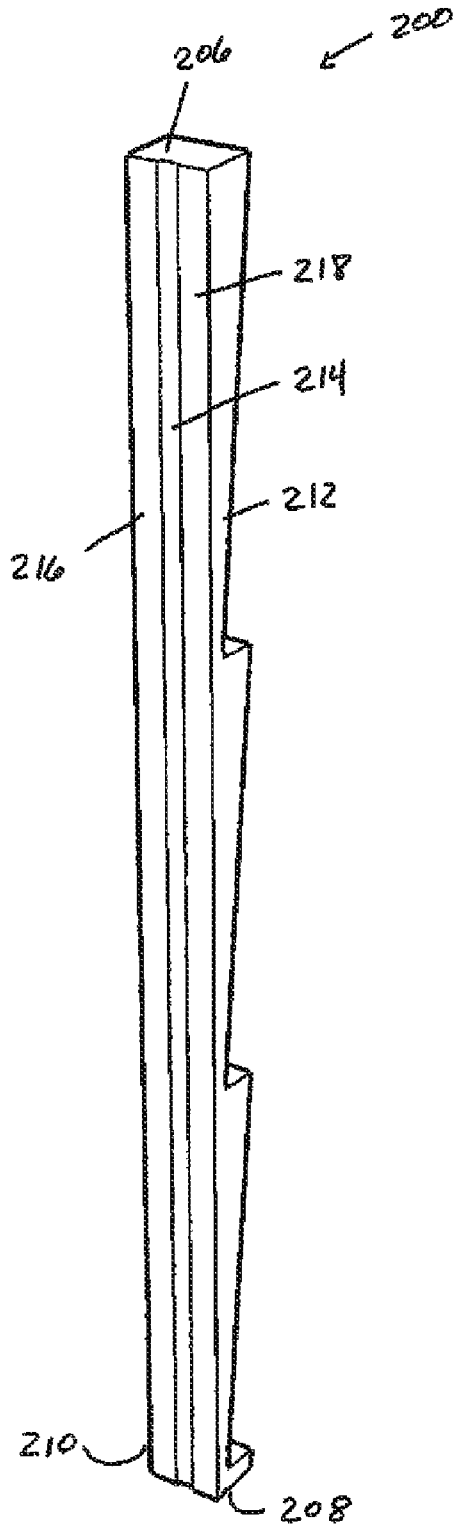
FIG. 5 is a schematic depicting a front side of the insert depicted in FIG. 4.
Figure 6:
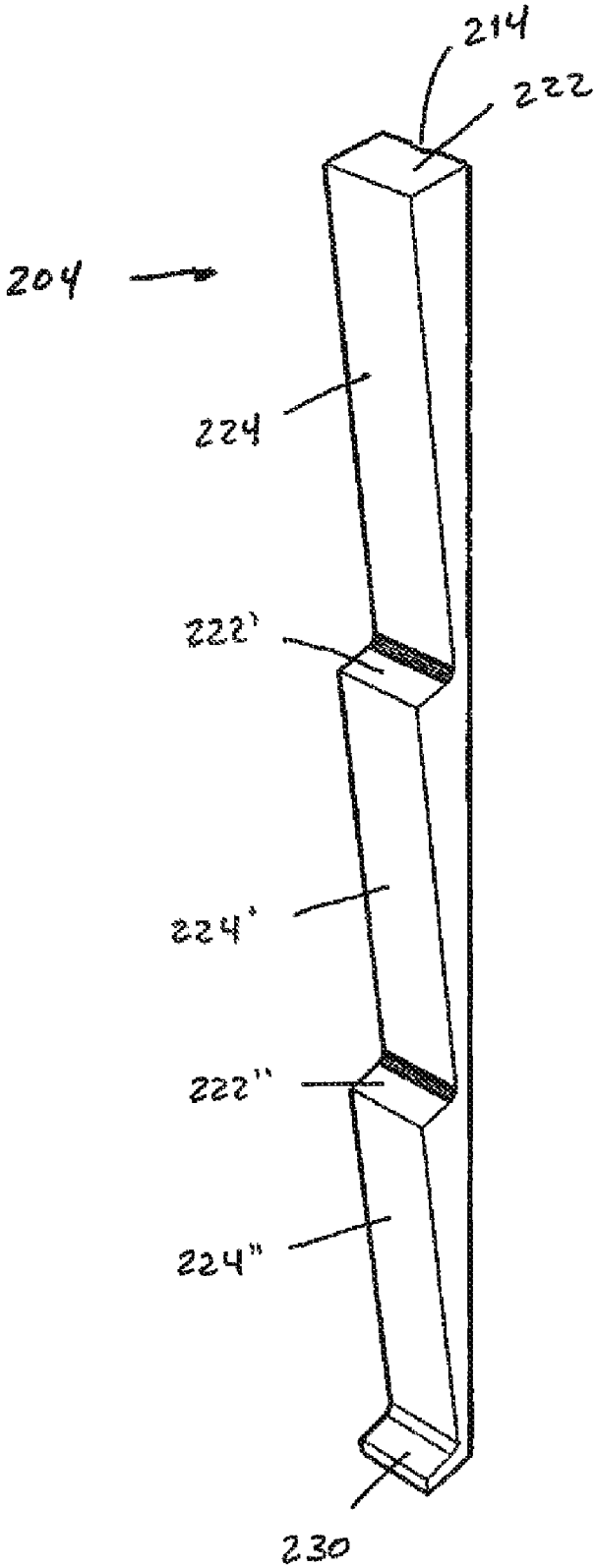
FIG. 6 is a schematic depicting a back side of the insert depicted in FIGS. 4 and 5.

The trim assembly of the present invention may further comprise an insert which works in cooperation with the trim member to create the look of butted cedar clapboard. An exemplary insert is depicted in FIGS. 4-6. Referring to FIGS. 4-6, an exemplary insert 200 comprises a longitudinally extending front side 202 opposite to a longitudinally extending back side 204, and a longitudinally extending lateral side 210 opposite to a longitudinally extending lateral side 212. Front side 202 comprises a longitudinally extending, substantially planar surface having a longitudinally extending groove 214 formed therein, wherein groove 214 bisects the substantially planar surface into a longitudinally extending first portion 216 and a longitudinally extending second portion 218. Groove 214 is configured to receive protrusion 122 of adaptor region 114 of trim member 100 such that second portion 218 of insert 200 abuts subsection 121 of trim member 100 and first portion 216 of insert 200 abuts subsection 119 of trim member 100 (see FIG. 10).

Figure 9:
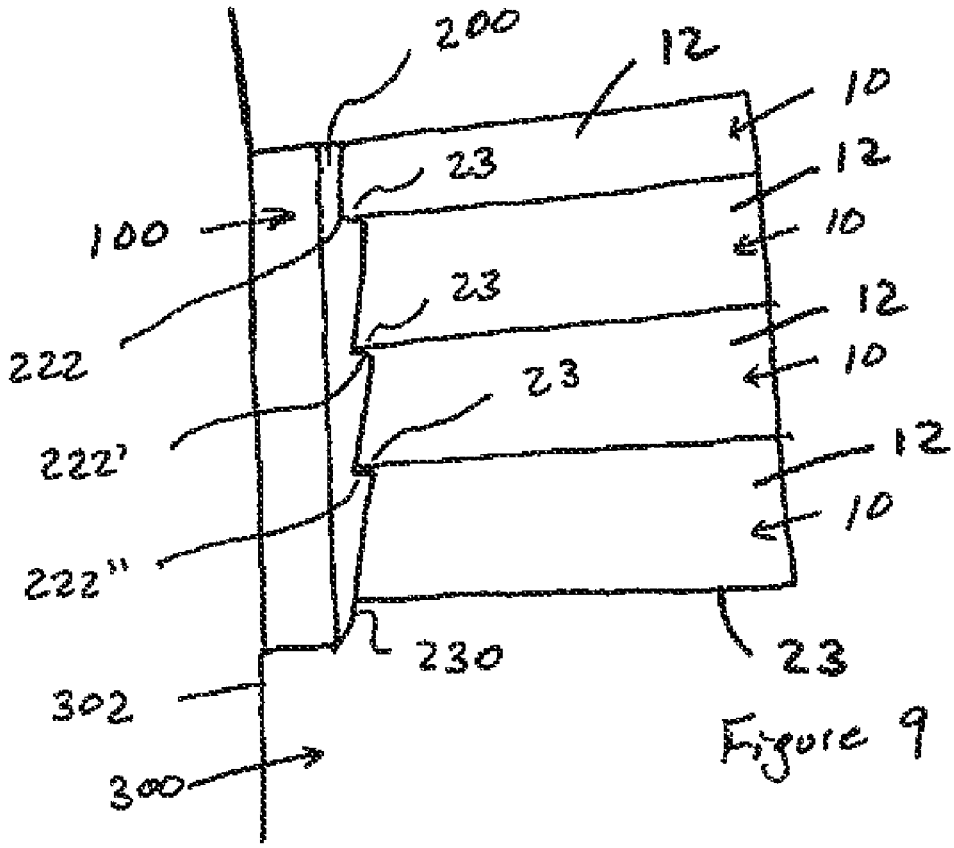
FIGS. 9 and 10 are schematics depicting another exemplary trim assembly and siding interaction.
Figure 10:
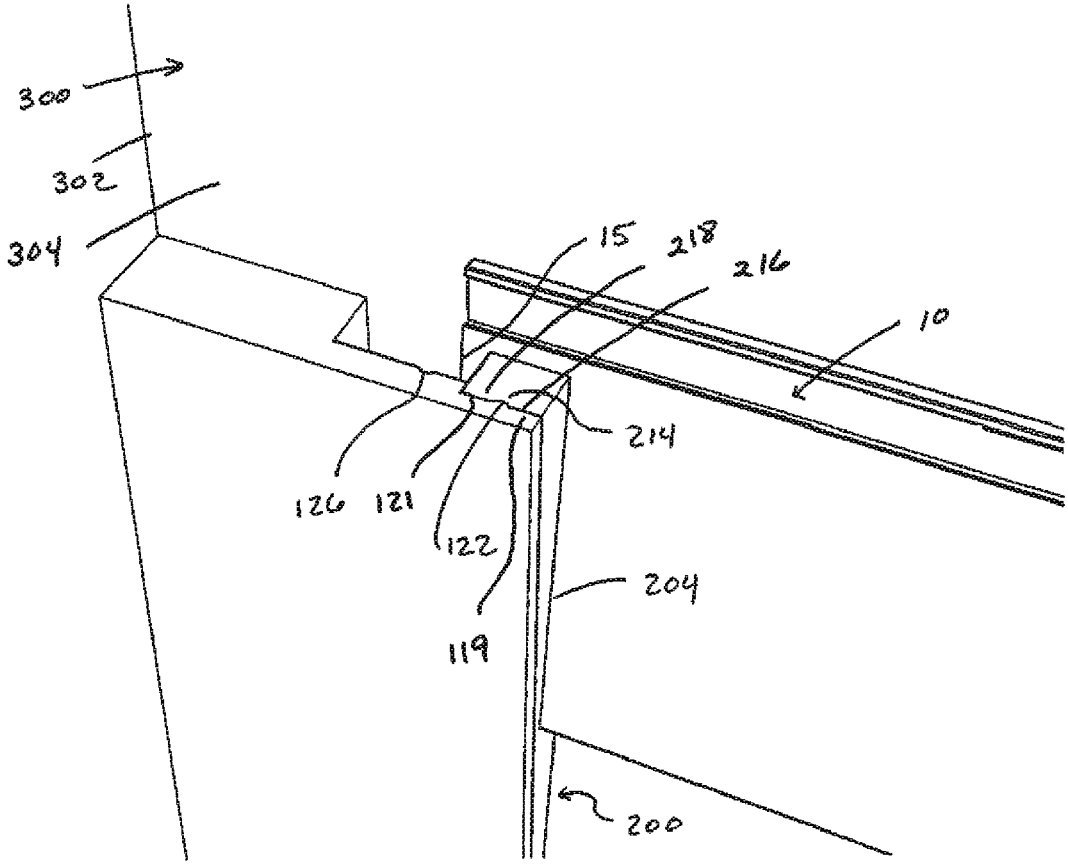

Referring to FIGS. 9 and 10, back side 204 of insert 200 is profiled to conform to a plurality of vertically overlapping siding 60 installed on a structure, such as, for example, an exterior wall. Accordingly, referring to FIGS. 4, 6, 9, and 10, back side 204 comprises siding engaging members 220, 220', and 220". Each of siding engaging members 220, 220', and 220" respectively comprises a top edge 222, 222', and 222", and a substantially planar surface 224, 224', and 224". Substantially planar surface 224 slopes downwardly towards substantially planar surface 224' until it terminates at top edge 222'; substantially planar surface 224' slopes downwardly towards substantially planar surface 224" until it terminates at top edge 222"; and substantially planar surface 224" slopes downwardly towards a foot 230 which turns outwardly away from surface 224" and away from front side 202, and which is configured to fit underneath and against bottom side 23 of siding 10. Accordingly, insert 200 is configured such that siding engaging member 220" overlaps siding engaging member 220', and siding engaging member 220' overlaps siding engaging member 220.

As previously stated, insert 200 works in combination with trim member 100 to create the effect of butted cedar clapboard. Accordingly, when used, bottom side 23 of an installed siding 10 abuts a respective top edge 222, 222', and 222", and face 12 rests against respective substantially planar surfaces 224, 224', and 224". Furthermore, groove 214 of insert 200 engages with protrusion 122 of trim member 100 while terminal lateral edge 15 of siding 10 is aligned with groove 126 of guide region 116 of trim member 100.

Although the trim member and the insert may be formed of a variety of materials, in an exemplary embodiment, the trim member and the insert are formed from cellular PVC.

The present invention has many advantages over the prior art. For example, as would be appreciated by those of skill in the art based on the present disclosure, the trim member can be applied to the wall without the need for caulks and/or adhesives. Additionally, the trim member provides ample space between the trim and the clapboard to thereby allow the clapboard to undergo its typical expansion and contraction without causing the clapboard to unnecessarily bulge, bow, splinter, fracture, and the like. The trim member also provides an aesthetically appealing trim for use with synthetic clapboards.

When used with the insert, the trim assembly further achieves the look of traditional butted cedar siding. Additionally, the insert may be easily snapped into the trim, thereby eliminating the need for extraneous materials, i.e., caulking and adhesives, to install the assembly. The insert is also configured to provide the siding with ample room along a horizontal and a vertical direction to allow the siding to expand and contract according to its natural characteristics.

Although the principles of the present invention have been illustrated and explained in the context of certain specific embodiments, it will be appreciated by those of skill in the art that various modifications beyond those illustrated can be made to the disclosed embodiment without departing from the principles of the present invention.

What is claimed is:

1. A trim assembly comprising:

a trim member comprising a longitudinally extending front side opposite to a longitudinally extending back side, wherein the longitudinally extending back side comprises:

a guide region comprising a longitudinally extending surface which is divided into a first longitudinally extending subsection and a second longitudinally extending subsection by a longitudinally extending groove; and a base region which extends rearward of the guide region, and which comprises a longitudinally extending step which is coterminous with and extends perpendicularly from the first longitudinally extending subsection of the guide region, and a longitudinally extending surface which is coterminous with and joined perpendicularly to the longitudinally extending step; and an adaptor region that is coterminous with the guide region and which comprises a longitudinally extending surface divided into a first longitudinally extending subsection of the adaptor region and a second longitudinally extending subsection of the adaptor region by a longitudinally extending protrusion; and a piece of siding, wherein the piece of siding comprises a longitudinally extending front face which terminates at a first terminal lateral edge and at an oppositely situated second terminal lateral edge;

wherein the first terminal lateral edge of the front face of the piece of siding is aligned with the longitudinally extending groove of the guide region such that the front face of the piece of siding is aligned with the second longitudinally extending subsection.

2. The trim assembly of claim 1, wherein the longitudinally extending front face of the piece of siding is in direct physical contact with the second longitudinally extending subsection of the guide region such that a gap is created between the adaptor region and the longitudinally extending front face of the piece of siding.

3. The trim assembly of claim 2, further comprising a wall having a surface which terminates at an edge, wherein the longitudinally extending surface of the base region is disposed on the surface of the wall to create an expansion channel between the longitudinally extending groove of the guide region, the longitudinally extending step of the base region, and the surface of the wall.

4. The trim assembly of claim 3, wherein the trim assembly further comprises a longitudinally extending lateral side which is coterminous with and perpendicular to the longitudinally extending front side of the trim assembly and to the base region, wherein the longitudinally extending lateral side of the trim assembly is aligned with the edge of the wall.

5. The trim assembly of claim 1, further comprising an insert, wherein the insert comprises a longitudinally extending front side opposite to a longitudinally extending back side, wherein the longitudinally extending front side comprises a longitudinally extending groove which divides the longitudinally extending front side into a longitudinally extending first portion and a longitudinally extending second portion, wherein the longitudinally extending groove of the insert receives the longitudinally extending protrusion of the adaptor region of the trim member.

6. The trim assembly of claim 5, wherein the longitudinally extending first portion of the insert abuts the first longitudinally extending subsection of the adaptor region, and the longitudinally extending second portion of the insert abuts the second longitudinally extending subsection of the adaptor region.

7. The trim assembly of claim 6, wherein the longitudinally extending front face of the piece of siding is physically disposed on the longitudinally extending back side of the insert.

8. The trim assembly of claim 7, wherein the disposition of the longitudinally extending front face of the piece of siding on the longitudinally extending back side of the insert creates the appearance of butted cedar clapboard.

9. The trim assembly of claim 8, further comprising a wall having a surface which terminates at an edge, wherein the longitudinally extending surface of the base region is disposed on the surface of the wall to create an expansion channel between the longitudinally extending groove of the guide region, the longitudinally extending step of the base region, and the surface of the wall.

10. The trim assembly of claim 9, wherein the trim assembly further comprises a longitudinally extending lateral side which is coterminous with and perpendicular to the longitudinally extending front side of the trim assembly and to the base region, wherein the longitudinally extending lateral side of the trim assembly is aligned with the edge of the wall.

11. The trim assembly of claim 6, wherein the longitudinally extending back side of the insert comprises a series of siding engaging members, wherein the series comprises an uppermost siding engaging member and a lowermost siding engaging member, and further wherein each engaging member in the series comprises a longitudinally extending top edge from which extends in a downwardly sloped manner a longitudinally extending, substantially planar surface.

12. The trim assembly of claim 11, wherein the longitudinally extending, substantially planar surfaces of all of the siding engaging members in the series, save for the lowermost siding engaging member, is coterminous with the longitudinally extending top edge of the immediately adjacent upper siding engaging member such that each subsequent siding engaging member extends rearward of its immediately upper preceding siding engaging member.

13. The trim assembly of claim 12, wherein the piece of siding comprises a longitudinally extending bottom side which forms a lowermost boundary of the piece of siding, and further wherein the longitudinally extending bottom side of the piece of siding is physically disposed on the longitudinally extending top edge of one of the siding engaging members such that the longitudinally extending front face of the piece of siding rests against the longitudinally extending, substantially planar surface of the immediately upper adjacent siding engaging member.

14. The trim assembly of claim 13, further comprising a wall having a surface which terminates at an edge, wherein the longitudinally extending surface of the base region is disposed on the surface of the wall to create an expansion channel between the longitudinally extending groove of the guide region, the longitudinally extending step of the base region, and the surface of the wall.

15. The trim assembly of claim 14, wherein the trim assembly further comprises a longitudinally extending lateral side which is coterminous with and perpendicular to the longitudinally extending front side of the trim assembly and to the base region, wherein the longitudinally extending lateral side of the trim assembly is aligned with the edge of the wall.

* * * * *